US006202841B1

(12) United States Patent
Kang

(10) Patent No.: US 6,202,841 B1
(45) Date of Patent: Mar. 20, 2001

(54) GOLF BAG WITH SEPARATOR TO PARTITION CLUB HEADS AND SHAFTS

(76) Inventor: Pan-gyu Kang, 916-62, Taechi-dong, Kangnam-ku, Seoul (KR)

( * ) Notice: Subject to any disclaimer, the term of this patent is extended or adjusted under 35 U.S.C. 154(b) by 0 days.

(21) Appl. No.: 09/327,426

(22) Filed: Jun. 7, 1999

(30) Foreign Application Priority Data

Apr. 28, 1999 (KR) ..... 99-15180

(51) Int. Cl.[7] ..... A63B 55/00
(52) U.S. Cl. ..... 206/315.6; 206/315.3
(58) Field of Search ..... 206/315.2, 315.6

(56) References Cited

U.S. PATENT DOCUMENTS

| | | | | |
|---|---|---|---|---|
| 2,685,317 | * | 8/1954 | Lace et al. | 206/315.6 |
| 3,331,419 | * | 7/1967 | Bencriscutto | 206/315.6 |
| 3,503,518 | * | 3/1970 | Black | 206/315.6 X |
| 4,055,207 | * | 10/1977 | Goodwin | 206/315.6 |
| 4,208,227 | * | 6/1980 | Cowan | 206/315.6 |
| 4,319,616 | * | 3/1982 | Light | 206/315.6 X |
| 4,911,465 | * | 3/1990 | Hauer | 206/315.6 X |
| 5,135,107 | * | 8/1992 | Ingraham | 206/315.6 |
| 5,228,566 | * | 7/1993 | Shanoha | 206/315.6 |
| 5,458,240 | * | 10/1995 | Rich et al. | 206/315.6 X |
| 5,465,839 | * | 11/1995 | Gretz | 206/315.6 X |
| 5,772,024 | * | 6/1998 | Lueders | 206/315.6 |
| 5,816,397 | * | 10/1998 | Pratt | 206/315.6 |
| 5,911,322 | * | 6/1999 | Lombardo et al. | 206/315.6 X |

* cited by examiner

*Primary Examiner*—Sue A. Weaver
(74) *Attorney, Agent, or Firm*—Blakely Sokoloff Taylor & Zafman

(57) ABSTRACT

A golf bag having an upper body formed in a cylindrical structure, a frame located in the top portion of the upper body to maintain the configuration of the golf bag, and a lower body installed in a bottom portion of the upper body. The lower body is used as a bottom part enclosing the bottom portion of the upper body. The golf bag also includes a separator connected to the frame for separating golf clubs that are inserted inside the upper body. This works towards preventing clashes between a head of the golf club and the frame as well as provides easy discernment of the heads of the golf clubs. The separator may include a base located in the center portion of the frame. The base may have an upper face slanted with an arbitrary angle, a partition board installed on the center portion of the upper face, and head partition members installed on the upper face to both sides of the partition board.

8 Claims, 6 Drawing Sheets

GOLF BAG WITH SEPARATOR TO PARTITION CLUB HEADS AND SHAFTS

CROSS-REFERENCES TO RELATED APPLICATIONS

This application is based on No. 99-15180 filed in the Korean Industrial Property Office on Apr. 28, 1999, the non-essential contents of which is incorporated herein by reference.

BACKGROUND OF THE INVENTION (a) Field of the Invention

The present invention includes a golf bag, more particularly to the golf bag equipped with a frame, the frame wherewith a tube set, whereby a plurality of golf clubs are separately divided, is easily assembled so that the golf clubs are not entangled with one another.

(b) Description of the Related Art

Golf bags have at times walls for achieving separate collection of the golf clubs.

The golf bag with inner walls thereinside, however, still has problem that though the golf clubs are separately secured inside the golf bag, in the upper portion of the bag do the golf clubs still clashes each other.

To solve the problem, either head covers may be put on the head portions of the golf clubs or multiple tubes may be installed for separately securing the inserted portions of the golf clubs.

These tubes are coupled to the inside of both the upper and lower portions of the golf clubs while the same are randomly coupled to the inside of the frame.

The golf clubs inserted into the respective tube are divided but both the upper portion and heads of the golf clubs either clash one another or are exposed to the outside of the golf bag.

The conventional golf bags, moreover, have the following defects:

(a) assembly of the golf bag becomes complicated because tubes for dividing the golf clubs inserted in the inside of the frame are coupled to the golf bag on the one by one basis, with the result that the golf bag becomes enlarged and an extra reinforced support member to prop up the tubes is required;

(b) the head covers of the golf clubs should be provided for preventing clashes among the golf clubs, and since the golf clubs are designed to move freely when the golf bag is moved around, there are made clangorous noises due to the clashes among themselves;

(c) since the tubes, though the identification number is inscribed on the heads of the golf clubs, are disorderly coupled to the golf bag, it is difficult and takes much time to identify the designated golf club out of the plurality of golf clubs inserted in the golf bag and to recognize what specific golf club is lost or missing.

(d) when the golf clubs are inserted into the tube of the golf bag, damage may be done on the protruded portion of the golf clubs that is extended out of the golf bag while the golf bag is carried around;

(e) the inside volume of the golf bag is not available for other purposes because the tubes are coupled down from the center portion of he golf bag.

SUMMARY OF THE INVENTION

The present invention made to solve the above problems provides a golf bag coupled with an integrated tube set wherein a number of golf clubs are divided up and inserted, the golf bag having a simplified assembly feature.

The present invention also provides a golf bag wherein though there is no extra head cover of the golf club, clashes among the golf clubs inserted inside the golf bag are prevented and therefore clangorous noises are not made when the golf bag is moved in any direction.

The present invention also provides a golf bag wherein the golf clubs inserted into the golf bag can be recognized in the shortest time possible, and an identification of the lost or missing golf club is effectively made.

The present invention also provides a golf bag wherein while the golf bag is either safekept or moved around, the golf club is not damaged by preventing the golf clubs from being extended out of the golf bag.

The present invention also provides a golf bag wherein the inside of the golf bag may be used for pockets.

The present invention also provides a golf bag wherein manufacturing of the golf bag is simplified and wherein pockets are designed to be placed inside the golf bag.

The present invention to accomplish the above purpose comprises:

an upper body formed in a cylindrical structure;

a frame disposed in the top portion of the upper body for maintaining the configuration of the golf bag;

a lower body installed in the bottom portion of the upper body used as a bottom part enclosing the bottom portion of the upper body.

The present invention is also made such that the frame is provided with the protrusively disposed insertion tubes spaced apart from the center portion of the frame for dividing up the golf clubs inserted into the golf bag, and the insertion tube is coupled as a unit with a tube set for separating and inserting the golf clubs that are placed through the insertion tube into the inside of the upper body.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Figure 1:
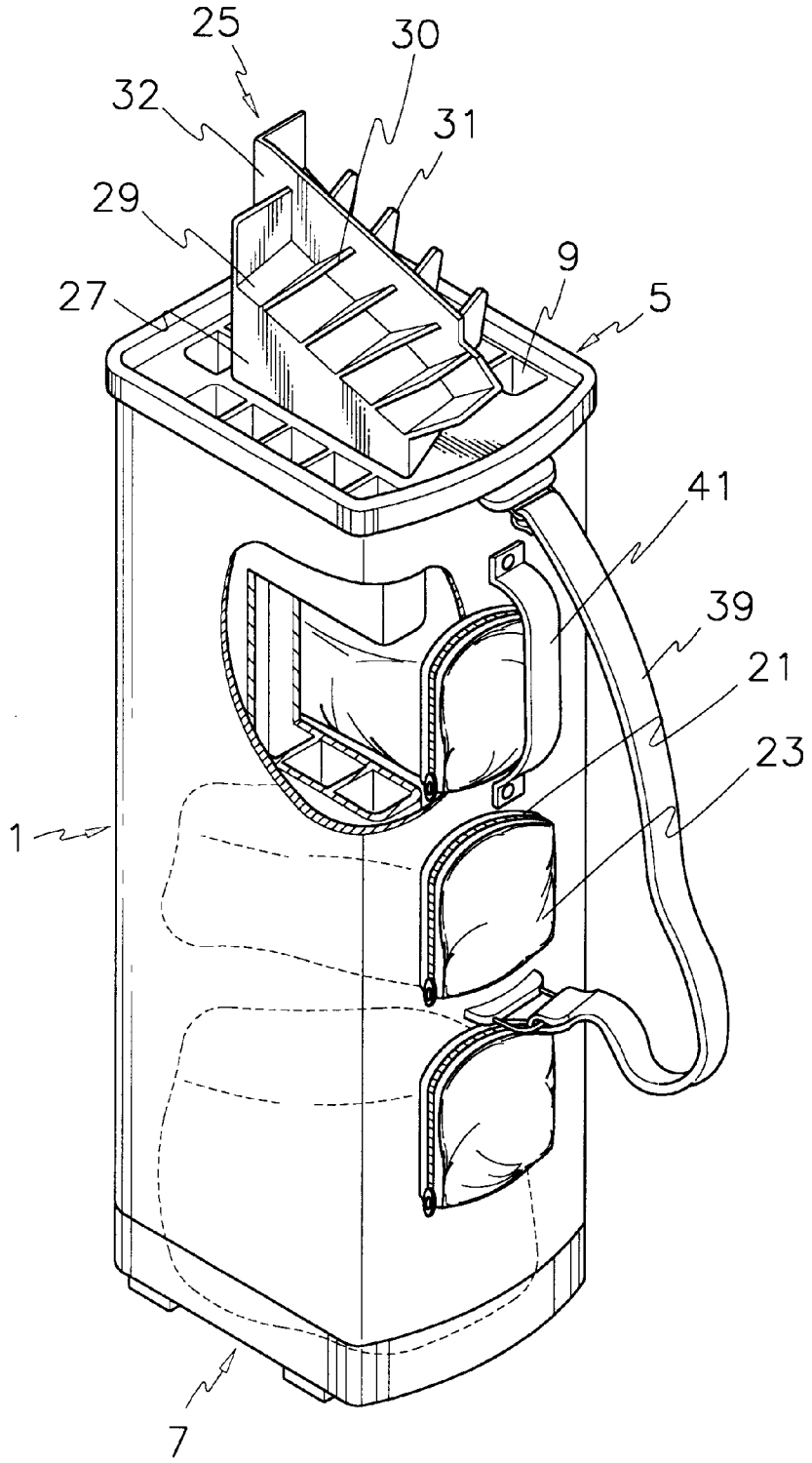
FIG. 1 is a partial cut away perspective view according to the first embodiment of the present invention.
Figure 2:
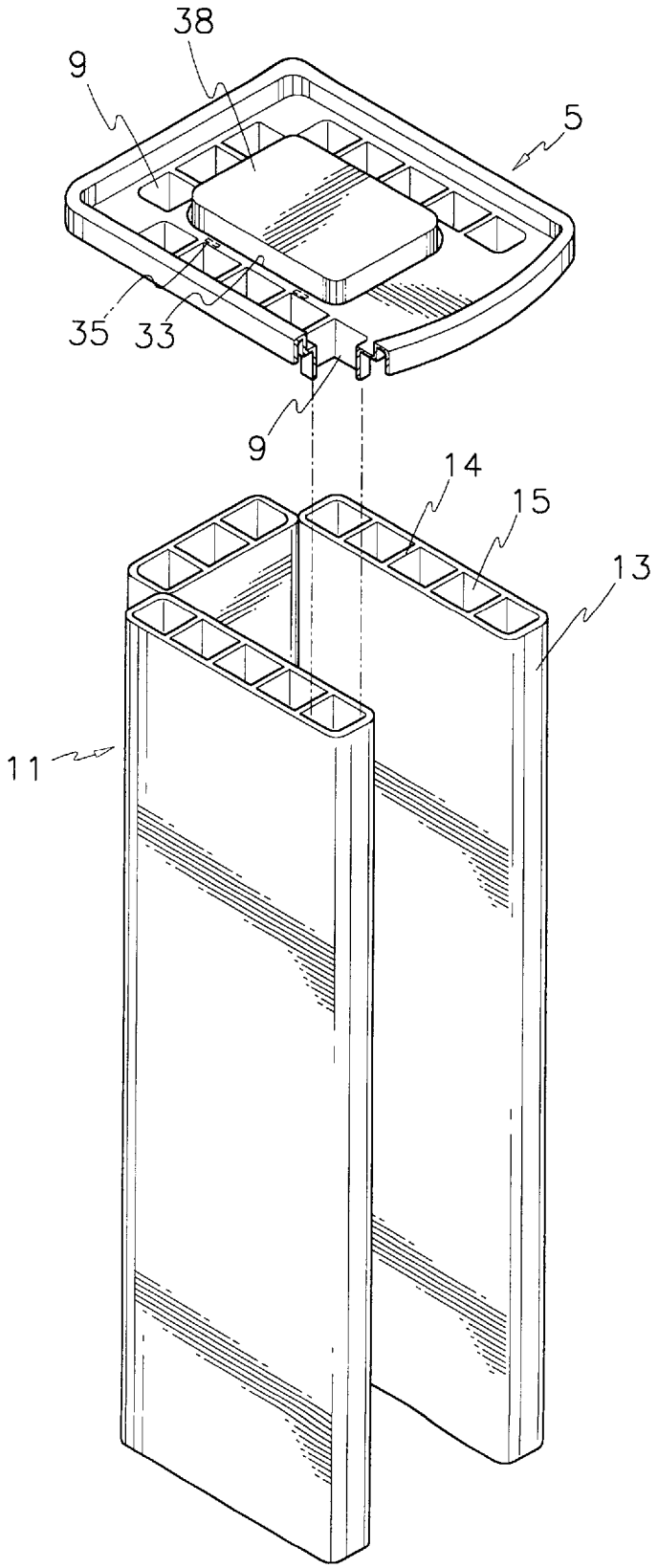
FIG. 2 is an exploded perspective view of main parts of the golf bag according to the first embodiment of the present invention.

In the following detailed description, only the preferred embodiment of the invention has been shown and described, simply by way of illustration of the best mode contemplated by the inventor of carrying out the invention. As will be realized, the invention is capable of modification in various respects, all without departing from the invention.

Accordingly, the drawings and description are to be regarded as illustrative in nature, and not restrictive.

Detailed description of the preferred embodiment of the present invention with reference to the appended drawings is made as follows.

The golf bag according to the present invention with reference to FIG. 1 through FIG. 4 comprises:

an upper body 1 formed in a cylindrical structure;

a frame 5 disposed in the top portion of the upper body 1 for maintaining the configuration of the golf bag; and a lower body 7 installed in the bottom portion of the upper body 1 acting as a bottom part enclosing the bottom portion of the upper body 1.

The upper body 1 is formed by sewing or rivetting as a unit with the frame 5 or the lower body 7.

The frame 5 is provided with the protrusively disposed insertion tube 9 spaced apart from the center portion of the frame for dividing up the golf clubs 100 inserted into the golf bag.

The insertion tubes 9 are coupled as a unit with a tube set 11 for separating and inserting the golf clubs that are placed through the insertion tubes 9 into the inside of the upper body 1.

The insertion tubes 9 are disposed such that the same are formed at the edge of the frame spaced at a predetermined interval so that the head 110 of the inserted golf club 100 may not be extended out the frame but rather remain within the frame 5.

The center portion of the frame 5 is preferably formed in a sealed pattern.

The insertion tubes 9 can be made in any pattern, including a rectangle and a circle, as far as the same can secure the golf clubs.

The tube set 11 comprises a tube body 13 making one end thereof opened and and having thereinside a predetermined volume of any shape wherein the golf clubs are secured, the body also provided with insertion holes 15 for the insertion of the golf clubs 100 that are separately arranged at a predetermined interval by a partition member 14 and coupled with the insertion tube 9 by insertion.

The lower portion of the body 13 is connected as a unit with a coupling home 19 formed by a protruded portion 17 that is made in the center portion of the lower body 7.

The tube body 13 is preferably made in a three dimentional rectanglular pattern with more than a predetermined structural strength.

The tube body 13 can also be made of a plurality of member units that are formed corresponding to the direction of installation of the insertion holes 15 and respectively formed at a predetermined interval.

The upper body 1 is provided with more than one pocket 23 in which items are secured and that are opened or closed with zipper 21, with a result that the inner space of a tube set 11 is effectively utilized.

The pockets 23 are preferably installed from the front side of the upper body 1 toward the inner space of the tube set so that the same may secure things more efficiently.

The frame 5 is provided with a separator 25 wherein the same contributes to confining the golf clubs 100 within the frame 5 while they do not strike one another and the separator 25 making the heads 110 of respective golf clubs 100 discerned from the outside and disposed toward the center area of the frame 5.

The above separator 25 comprises a base 27 disposed in the center portion of the frame 5 and head partition members 30 and 31 installed on one face of the base 27 for separating and securing toward the partition board 32 the heads 110 of each golf club 100 and fixing them in place.

An upper face of the base 27 is formed with a slanted portion 29 so that the golf clubs 100 divided by the partition member 30 and 31 may be easily discerned and stably secured.

The head partition members 30 and 31 are preferably designed such that the same of each row are formed with different angles to improve the discernment of the heads of the golf clubs from the outside.

The above base 27 can also be provided with a partition board 32 for separating each head partition member 30 and 31.

Figure 3:
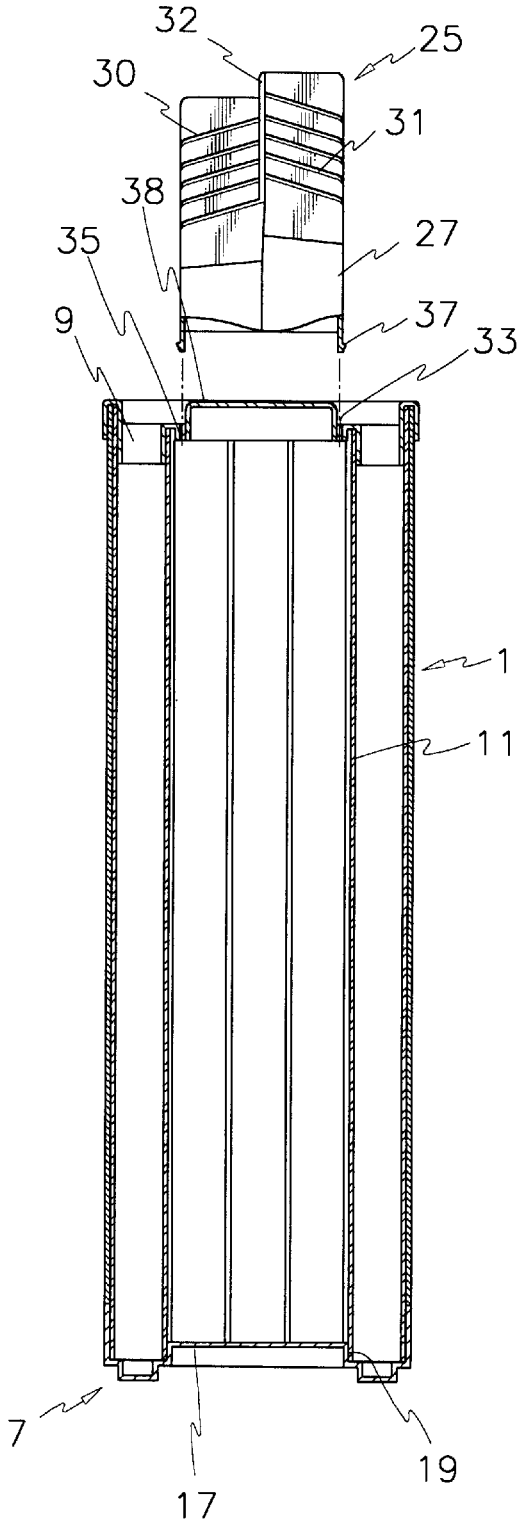
FIG. 3 is a cross sectional view of a golf bag according to the first embodiment of the present invention.
Figure 4:
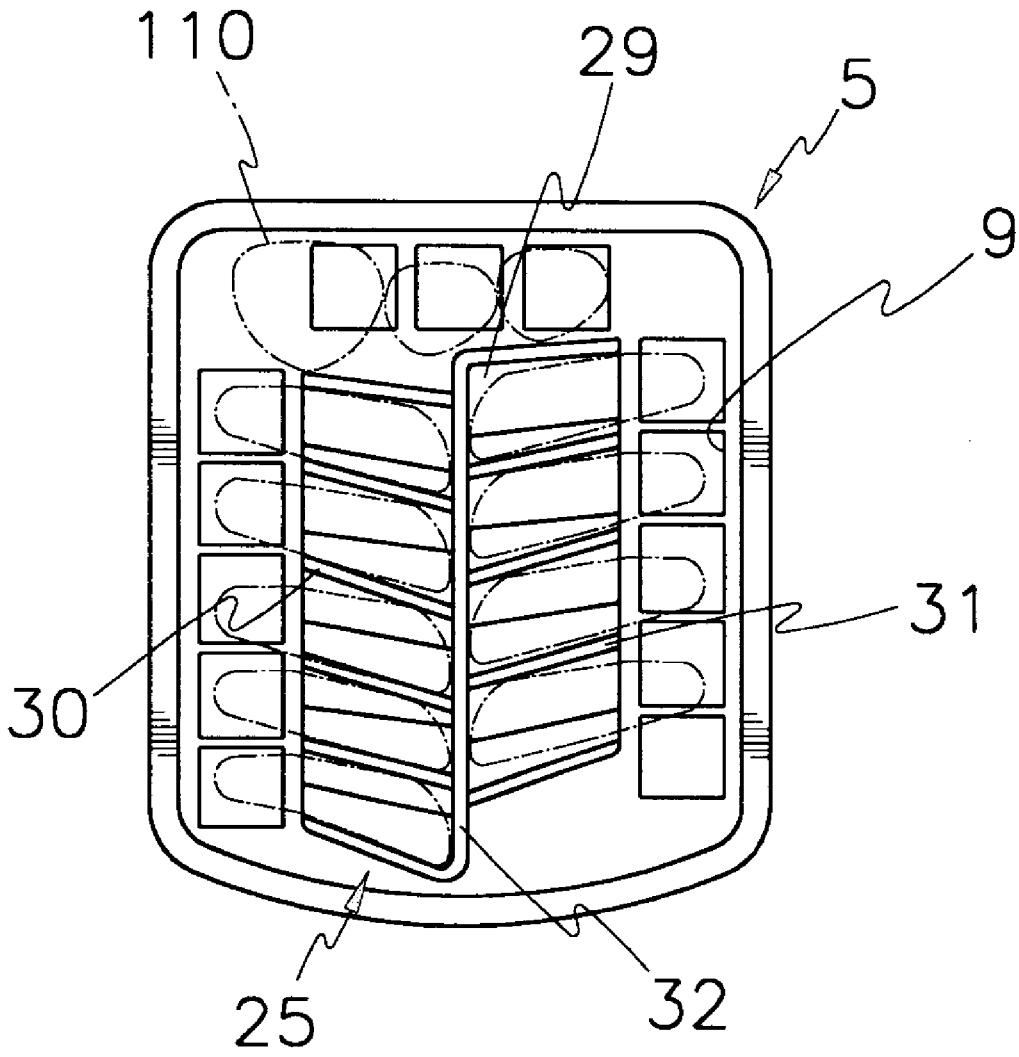
FIG. 4 is a plane view of a golf bag according to the first embodiment of he present invention.
Figure 5:
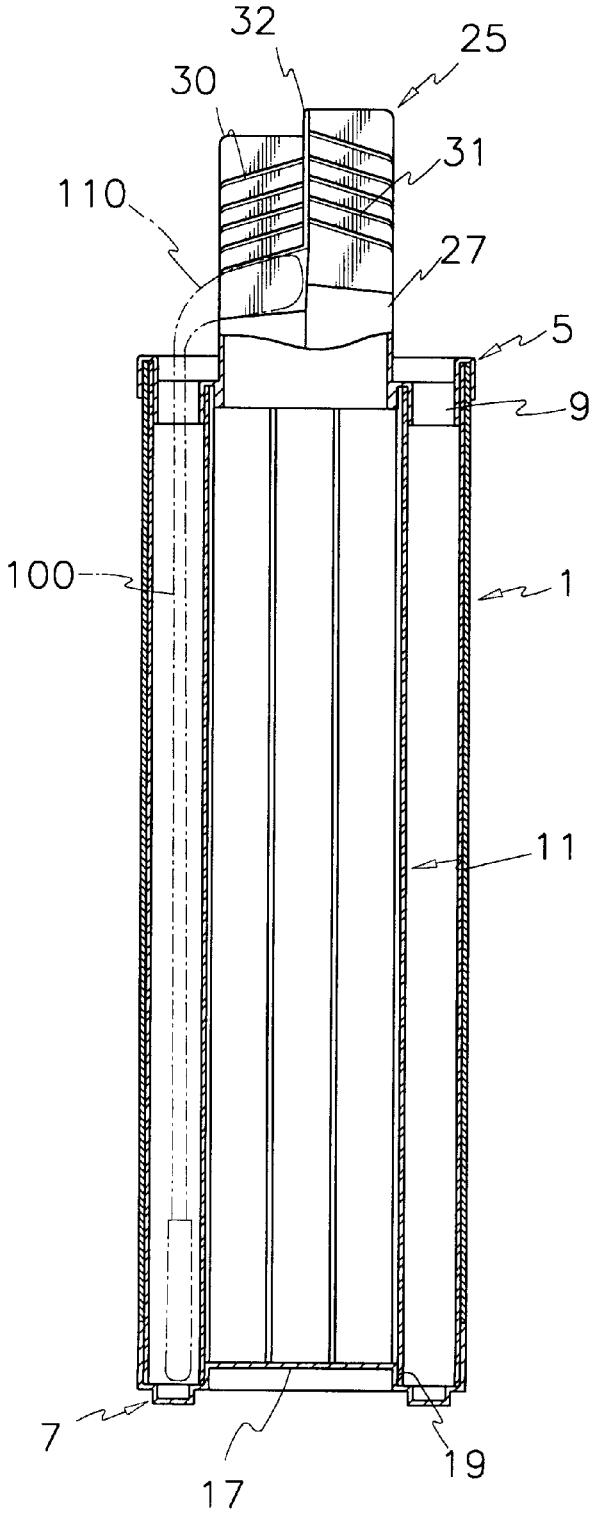
FIG. 5 is a cross sectional view of the golf bag according to the second embodiment of the present invention.

The base 27 is either made as a unit with a frame 5, or made detachably by means of an extra coupling means to thus facilitate the coupling of the upper body 1 to the frame 5 as shown in FIG. 3.

The above mentioned coupling means comprises a coupling home 33 of a predetermined size formed in the center portion of the frame 5 and a hook protrusion 37 that is protrusively formed on one side face of the base 27 and is intended to be connected to a hook hole 35 formed in the coupling home 33.

The heights of the head partition member 30 and 31 of each row are either made the same or differently according to the length of the golf clubs to make an easy discernment of each identification number inscribed on the heads 110 of the golf clubs 100.

The above head partition members 30 and 31 are formed at a predetermined angle with respect to the slated portion 29 that the heads 110 of the golf clubs 100 are precisely secured and convincingly settled.

The above head partition members 30 and 31 are preferably made of a soft material that causes no damage to the heads of the golf clubs 100 and minimizes contact noise.

In the center portion of the above frame 5 is disposed a protrusion portion 38 protrusively formed and having a predetermined thickness for facilitating insertion of the hook protrusion 37 of the coupling means into the coupling home 33 and for propping up the separator 25.

The inside of a cover, not shown, for covering the upper portion of the golf bag is preferably made such that the same is formed with different heights corresponding to the head partition members 30 and 31 of the separator 25 that the golf club 100 may not run away even if the golf bag is even turned upside down.

Element 39 of FIG. 1 is a golf bag string, and a part 41 is a portable strap 41.

The golf bag of the present invention, while the upper body 1 is coupled with both the frame 5 and the lower body 7, is made such that the upper portion of the body tube 13 of the tube set 11 is coupled to the insertion tubes 9 of the frame 5 by insertion to thus form a unit, and the lower portion of the body tube 13 is coupled to the coupling home 19 formed in the lower body 7 by insertion to thus form a unit.

The separator 25, while the base 27 of the separator 25 is inserted into the coupling home 33 formed in the center portion of the frame 5, is coupled to the frame 5 by hooking the hook protrusion 37 of the base 27 into the hook hole 35.

In the state of the above mentioned structural setting, when the golf clubs 100 is respectively inserted into separate insertion tubes, the golf clubs 100 are inserted into the insertion holes 15 of the tube set 11 to thus be secured separately.

The heads 110 of the golf clubs 100 exposed outside the insertion tubes 9 and separately secured by means of the head partition members 30 and 31, the partition board 32, and the slanted portion 29 of the separation means 25 have the following advantages:

a) the golf club heads do not clash with each other;

b) unstable movement of the heads of the golf clubs is prevented though the golf bag moves in any direction; and c) the identification number of each head of the golf clubs secured in each head partition member 30 and 31 may easily be discerned from the outside.

The pockets 23 disposed in the front side of the upper body 1 are opened with zipper 21 to secure things, as well as accommodate many things of large size because the inside volume of the tube set 11 is fully used for storage space.

Figure 6:
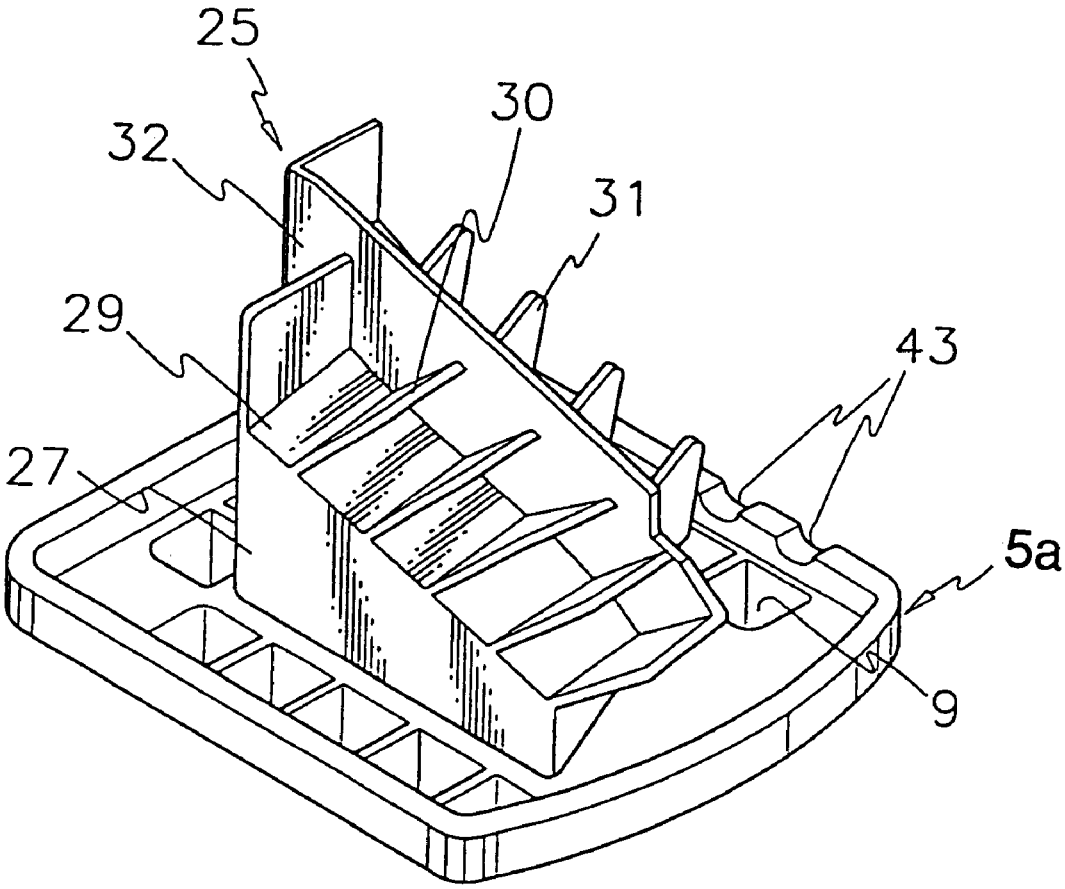
FIG. 6 is a partial perspective view of the golf bag according to the third embodiment of the present invention.

FIG. 6 shows a third embodiment of the present invention, the third embodiment has the same technical features as the first embodiment of the present invention other than the hereinafter mentioned description.

The golf bag according to the third embodiment of the present invention is provided with one or more than one fixation homes 43 or protruded fixation members that are formed along the edge of the frame 5*a* in an insertion homed pattern or protruded membered pattern, the fixation homes 43 or protruded fixation members whereinto the head portions 110 of the golf clubs 100 are settled through insertion when the head portions 110 of the golf clubs are required to be disposed toward the outside of the frame 5*a* before the specific golf clubs being inserted in the insertion tube 9 can be actually used for the game.

The above fixation homes 43 or the protruded fixation members are preferably formed at the frame area located nearest possible from the insertion tube 9 wherein the most frequently used golf clubs, especially the putter 100, are secured.

The above fixation homes 43 or the protruded fixation members are preferably formed in rounding patterns so that a damage to the head portions 110 of the golf clubs 100 may be prevented when the head portions of the golf clubs are inserted into the fixation homes 43 or the protruded fixation members, and may facilitate the insertion or separation of the head portions of the golf clubs.

The present invention, with a tube set whereby a plurality of golf clubs are divided and inserted are assembled as a unit, also has the following merits:

(a) assembly is conveniently completed and the tube set has a predetermined self structural strength, so that there is no need for extra reinforced support member;

(b) the golf clubs are secured within the outside surface of the golf bag that the same may be free from damage at the time the golf bag is carried around;

(c) the inside space of the golf bag can be used for pockets and the golf bag may be manufactured with more ease such that the pockets are designed to be placed inside the golf bag;

(d) the golf clubs secured in the golf bag that is made without head covers for the golf clubs have no crash problem with each other and the golf clubs, though the golf bag is carried around, are stably settled in the insertion tube to thus make no clashing noise; and (e) the golf clubs inserted in the golf bag can be identified in the shortest time possible and at the same time any lost or missing golf club can be easily recognized.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed:

1. A golf bag comprising:

an upper body formed in a cylindrical structure;

a frame disposed in the top portion of the upper body for maintaining the configuration of the golf bag;

a lower body installed in a bottom portion of the upper body used as a bottom part enclosing the bottom portion of the upper body; and a separation means connected to the frame for separating golf clubs that are inserted inside the upper body in order to prevent clashes between a head of the golf club and the frame and for the easy discernment of the heads of the golf clubs, wherein the separation means includes a base disposed in the center portion of the frame and having a upper face slanted with an arbitrary angle, wherein the base is made detachable by means of an extra coupling means to thus facilitate a coupling of the upper body to the frame, a partition board installed on the center portion of the upper face, and head partition members installed on the upper face to both sides of the partition board.

2. A golf bag according to claim 1, wherein the height of the head partition members is either made the same or differently corresponding to the length of the golf clubs to make an easy discernment of each identification number inscribed on the heads of the golf clubs according to the length of the golf clubs.

3. A golf bag according to claim 2, wherein the head partition members are formed at a predetermined angle with respect to the upper face of the base so that the heads of the golf clubs are precisely secured and convincingly settled.

4. A golf bag according to claim 1, wherein the head partition members are formed at a predetermined angle with respect to the upper face of the base so that the heads of the golf clubs are precisely secured and convincingly settled.

5. A golf bag comprising:

an upper body formed in a cylindrical structure:

a frame disposed in the top portion of the upper body for maintaining the configuration of the golf bag;

a lower body installed in a bottom portion of the upper body used as a bottom part enclosing the bottom portion of the upper body; and a separation means connected to the frame for separating golf clubs that are inserted inside the upper body in order to prevent clashes between a head of the golf club and the frame and for the easy discernment of the heads of the golf clubs, wherein the separation means is provided with one or more than one fixation homes formed along the edge of the frame in an insertion homed pattern, wherein the separation means includes a base disposed in the center portion of the frame and having a upper face slanted with an arbitrary angle, wherein the base is made detachable by means of an extra coupling means to thus facilitate a coupling of the upper body to the frame, a partition board installed on the center portion of the upper face, and head partition members installed on the upper face to both sides of the partition board.

6. A golf bag comprising:

an upper body formed in a cylindrical structure;

a frame disposed in the top portion of the upper body for maintaining the configuration of the golf bag;

a lower body installed in a bottom portion of the upper body used as a bottom part enclosing the bottom portion of the upper body;

a insertion tubes disposed at regular spaced intervals from the center portion of the frame for separately securing golf clubs inserted inside the golf bag;

a tube set coupled as a unit with the insertion tube for separating and inserting the golf clubs that are placed through the insertion tubes into the inside of the upper body; and a separation means connected to the frame for separating golf clubs that are inserted inside the upper body in order to prevent clashes between a head of the golf club and the frame and for the easy discernment of the heads of the golf clubs, wherein the tube set comprising:

a body formed with one end thereof opened and having thereinside an arbitrary volume of a predetermined shape wherein the golf clubs are secured; and a plurality of partition members coupled with the body at predetermined intervals so that an insertion hole is for an insertion of the golf club, wherein the separation means comprises, a base disposed in the center portion of the frame and having a upper face slanted with an arbitrary angle;

a partition board installed on the center portion of the upper face; and head partition members installed on the upper face to both sides of the partition board.

7. A golf bag according to claim 6, wherein the body is made of a plurality of member units that are formed corresponding to the direction of the insertion hole and respectively formed at predetermined intervals.

8. A golf bag according to claim 6, the upper body provided with more than one pocket in which items are secured and that are opened or closed with zippers, with a result that the inner space of the tube set is effectively utilized.

* * * * *